US005712027A

United States Patent [19]

Ali et al.

[11] Patent Number: 5,712,027

[45] Date of Patent: Jan. 27, 1998

[54] INK-RECEPTIVE SHEET

[75] Inventors: Mahfuza B. Ali, Mendola Heights; Omar Farooq, Woodbury, both of Minn.; Mohammed Iqbal; Alan G. Miller, both of Austin, Tex.

[73] Assignee: Minnesota Mining and Manufacturing Company, St. Paul, Minn.

[21] Appl. No.: 761,920

[22] Filed: Dec. 9, 1996

Related U.S. Application Data

[60] Division of Ser. No. 428,276, Apr. 25, 1995, Pat. No. 5,589,269, which is a continuation-in-part of Ser. No. 204,354, Mar. 11, 1994, abandoned, which is a continuation-in-part of Ser. No. 30,811, Mar. 12, 1993, Pat. No. 5,342,688.

[51] Int. Cl.[6] ..... B41M 5/00

[52] U.S. Cl. ..... 428/212; 428/195; 428/213; 428/323; 428/327; 428/412; 428/419; 428/474.4; 428/500; 428/532

[58] Field of Search ..... 428/195, 212, 428/213, 323, 327, 412, 419, 474.4, 500, 532

[56] References Cited

U.S. PATENT DOCUMENTS

| | | | |
|---|---|---|---|
| 2,945,006 | 7/1960 | Minsk | 260/65 |
| 4,225,652 | 9/1980 | Mercer et al. | 428/515 |
| 4,300,820 | 11/1981 | Shah | 351/160 H |
| 4,301,195 | 11/1981 | Mercer et al. | 427/261 |
| 4,369,229 | 1/1983 | Shah | 428/421 |
| 4,379,804 | 4/1983 | Eisele et al. | 428/332 |
| 4,500,631 | 2/1985 | Sakamoto et al. | 430/413 |
| 4,695,531 | 9/1987 | Delfino et al. | 430/513 |
| 4,935,307 | 6/1990 | Iqbal et al. | 428/500 |
| 5,134,198 | 7/1992 | Stofko, Jr. et al. | 525/205 |

FOREIGN PATENT DOCUMENTS

| | | | |
|---|---|---|---|
| 931270 | 5/1971 | Italy | 428/195 |
| 63-307979 | 12/1988 | Japan | 428/195 |

OTHER PUBLICATIONS

*Properties of Polymers: Correlations with Chemical Structure*, D.W. Van Krevelin, P.J. Hoftyzer, Elsevier Publishing Co., (Amsterdam, London, New York, 1972), pp. 294–296.

*Acids, Maleic and Fumaric*, G.L. Brownell, Encyclopedia of Polymer Science and Technology, vol. 1, John Wiley & Sons, Inc. (New York, 1974), pp. 67–95.

*Primary Examiner*—Bruce H. Hess
*Attorney, Agent, or Firm*—Darla P. Neaveill

[57] ABSTRACT

An improved ink-receptive sheet comprising a substrate bearing on at least one major surface thereof an ink-receptive layer which comprises at least one ink receptive polymer and an effective amount of polymeric mordant having the general structure:

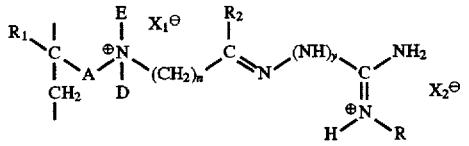

wherein

A is selected from the group consisting of a COO-alkylene group having from 1 to about 5 carbon atoms, a CONH-alkylene group having from 1 to about 5 carbon atoms, —COO—$(CH_2CH_2O)$n—$CH_2$, —CONH—$(CH_2CH_2O)$n—$CH_2$— and —$(CH_2CH_2NH_2Cl)$n, wherein n is from 1 to about 5;

E and D are independently selected from the group consisting of alkyl group having from 1 to about 5 carbon atoms;

or A, E, D and N are combined to form a heterocyclic compound selected from the group consisting of

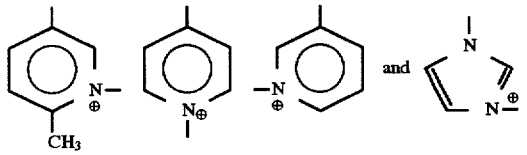

$R_1$ and $R_2$ are independently selected from the group consisting of hydrogen, phenyl, and an alkyl group containing from 1 to about 5 carbon atoms;

R is selected from the group consisting of hydrogen, phenyl, benzimidazolyl, and an alkyl group containing from 1 to about 5 carbon atoms, y is selected from 0 and 1, and $X_1$ and $X_2$ are anions.

12 Claims, No Drawings

INK-RECEPTIVE SHEET

This application is a divisional application of U.S. application Ser. No. 08/428,276, filed Apr. 25, 1993, now U.S. Pat. No. 5,589,269, which is a continuation-in-part of U.S. application Ser. No. 08/204,354, filed Mar. 11, 1994, now abandoned, which was a continuation-in-part of U.S. application Ser. No. 08/030,811, filed Mar. 12, 1993, now U.S. Pat. No. 5,342,688.

FIELD OF THE INVENTION

The invention relates to materials that can be used as ink-receptive sheets for imaging, especially transparent materials, having improved ink-receptive layers which exhibit improved shelf life after imaging.

DESCRIPTION OF THE RELATED ART

Imaging devices such as ink jet printers and pen plotters are established methods for printing various information including labels and multi-color graphics. Presentation of such information has created a demand for ink-receptive imageable sheets useful for commercial graphics, and for transparent ink receptive imageable receptors that are used as overlays in technical drawings and as transparencies for overhead projection.

Imaging with either the ink jet printer or the pen plotter involves depositing ink on the surface of these receptors. These imaging devices conventionally utilize inks that can remain exposed to air for long periods of time without drying out.

Since it is desirable that the surface of these receptors be dry and non-tacky to the touch, even after absorption of significant amounts of liquid soon after imaging, transparent materials that are capable of absorbing significant amounts of liquid while maintaining some degree of durability and transparency, are useful as imageable receptors for imaging.

Compositions useful as liquid-absorbent receptors have been formed by blending and coating a liquid-soluble polymeric material with a liquid-insoluble polymeric material. The liquid-insoluble materials are presumed to form a matrix, within which the liquid-soluble materials reside. Examples of such blends are disclosed in U.S. Pat. Nos. 4,300,820, 4,369,229, and 4,935,307. A problem in using the various blends of liquid-absorbent polymers is the basic incompatibility of the matrix-forming insoluble polymer with the liquid being absorbed, thus it can inhibit the absorption capability of the liquid-absorbent component to some extent and may increase the drying time.

Liquid-absorbent materials disclosed in U.S. Pat. No. 5,134,198 attempt to improve drying and decrease dry time. These materials comprise crosslinked polymeric compositions capable of forming continuous matrices for liquid absorbent semi-interpenetrating polymer networks. These networks are blends of polymers wherein at least one of the polymeric components is crosslinked after blending to form a continuous network throughout the bulk of the material, and through which the uncrosslinked polymeric components are intertwined in such a way as to form a macroscopically homogenous composition. Such compositions are useful for forming durable, ink absorbent, transparent graphical materials without the disadvantages of the materials listed above.

Generation of an image by an ink jet printer results in large quantities of solvent, generally blends of glycols and water, which remain in the imaged areas. Diffusion of this solvent into unimaged areas can result in "bleeding" of the image, when the dye is carried along with the solvent.

Materials disclosed in the above references do not address this effect, which is magnified with transparency materials. This magnification occurs when the imaged films are stored at elevated temperatures and high humidity conditions, or when the solvent is prevented from leaving the film, e.g., when the imaged film is placed in a transparency protector. Since the majority of the solvent is generally absorbed and not evaporated, and the absorbent coatings are usually very thin and thus provide more chances for lateral diffusion, the bleeding effect becomes more severe upon aging or archiving.

Japanese patent publication 63-307979 teaches the use of certain quaternary ammonium containing polymer mordants in an ink jet film and claims to show no running or spreading of ink during the ink jet recording process, thereby giving good initial resolution, high density, good color reproduction and lustre. However, no mention is made of preventing bleeding upon aging or archiving.

The present inventors have now discovered a transparent ink-receptive material, which when used as an ink receptive layer in an ink receptive sheet or transparency, yields improved shelf life after imaging. Even after the imaged film is exposed to elevated temperature and high humidity, and also when stored in a transparency protector, bleeding is dramatically reduced.

OTHER ART

Polymeric mordants are well known in the photographic sciences and normally comprise materials containing quaternary ammonium groups, or less frequently phosphonium groups.

U.S. Pat. No. 2,945,006 comprises mordants which are reaction products of aminoguanidine and carbonyl groups, having the following generic formula:

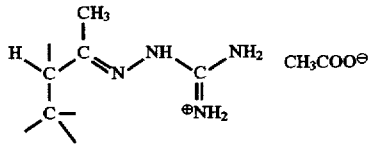

U.S. Pat. No. 4,695,531 discloses mordants in a light-sensitive silver halide element for radiographic use. A spectrally sensitized silver halide emulsion layer is coated on at least one side of a transparent base, and coated between the base and the silver halide emulsion layer is a hydrophilic colloid layer containing a water-soluble acid dye capable of being decolorized during the photographic process. This dye is associated with a basic polymeric mordant comprising the following repeating unit:

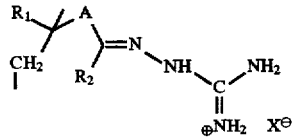

wherein $R_1$ is hydrogen or a methyl group, A is a —COO— or —COO-alkylene group, $R_2$ is hydrogen or a lower alkyl group, and X is an anion. There is no mention of using such mordants in an ink receptive layer.

Another photographic mordant is disclosed in an Italian Patent No. 931,270 having the following structure:

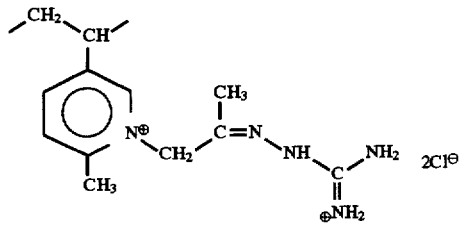

No mention of its use in an ink receptive layer is made.

Non-diffusive mordants based on poly(N-vinylimidazole) is disclosed in U.S. Pat. No. 4,500,631. These are used in radiographic image-forming processes where the mordants are coupled with water-soluble dyes. Again, no mention is made of use in ink-receptive layers.

SUMMARY OF THE INVENTION

The invention provides an improved ink-receptive layer, and ink-receptive sheets having an improved ink-receptive layer, which exhibits longer imaged shelf life, even when exposed to elevated temperatures and humidity. The sheets of the invention show a marked reduction in ink "bleeding" and thus remain useful over a long period of time. The sheets even show an improved life when stored in a transparent film "sleeve" protector.

The improved ink-receptive sheets of the invention comprise a substrate bearing on at least one major surface thereof, an ink-receptive layer comprising an ink receptive polymer and an effective amount of at least one polymeric mordant comprising a guanidine functionality having the following general structure:

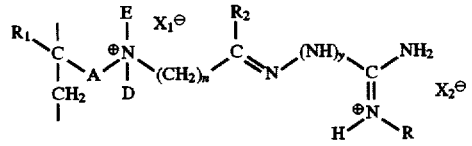

wherein

A is selected from the group consisting of a COO-alkylene group having from 1 to about 5 carbon atoms, a CONH-alkylene group having from 1 to about 5 carbon atoms, —COO—$(CH_2CH_2O)$n—$CH_2$—, CONH—$(CH_2CH_2O)$n—$CH_2$—, and -($CH_2$—$CH_2$—$NH_2Cl$-)n wherein n is from 1 to about 5;

E and D are separately selected from the group consisting of alkyl group having from 1 to about 5 carbon atoms;

or A, E, D and N are combined to form a heterocyclic compound selected from the group consisting of

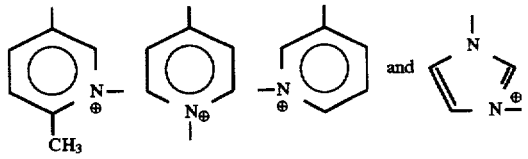

$R_1$ and $R_2$ are independently selected from the group consisting of hydrogen, phenyl, and an alkyl group containing from 1 to about 5 carbon atoms;

R is selected from the group consisting of hydrogen, phenyl, benzimidazolyl, and an alkyl group containing from 1 to about 5 carbon atoms, y is selected from the group consisting of 0 and 1, and $X_1$ and X2 are anions.

Preferably, the improved ink-receptive sheets of the invention comprise a substrate bearing on at least one major surface thereof, an ink-receptive layer comprising:

a) at least one crosslinkable polymeric component;

b) at least one liquid-absorbent component; and c) an effective amount of at least one polymeric mordant comprising a guanidine functionality having the following general structure:

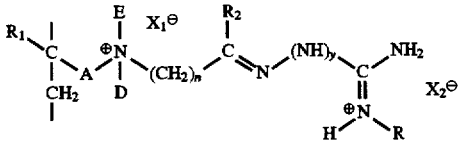

wherein

A is selected from the group consisting of a COO-alkylene group having from 1 to about 5 carbon atoms, a CONH-alkylene group having from 1 to about 5 carbon atoms, —COO—$(CH_2CH_2O)$n—$CH_2$—, —CONH—$(CH_2CH_2O)$n—$CH_2$—, and -($CH_2$—$CH_2$—$NH_2Cl$-)n, wherein n is from 1 to about 5;

B and D are separately selected from the group consisting of alkyl group having from 1 to about 5 carbon atoms;

or A, E, D and N are combined to form a heterocyclic compound selected from the group consisting of

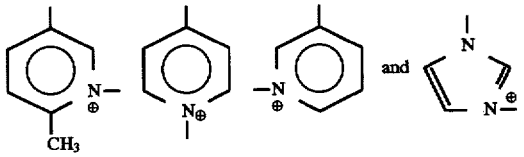

$R_1$ and $R_2$ are independently selected from the group consisting of hydrogen, phenyl, and an alkyl group containing from 1 to about 5 carbon atoms;

R is selected from the group consisting of hydrogen, phenyl, benzimidazolyl, and an alkyl group containing from 1 to about 5 carbon atoms, y is selected from the group consisting of 0 and 1, and $X_1$ and $X_2$ are anions.

In preferred embodiments, the ink-receptive composition comprises from about 1 part by weight to about 15 parts by weight of the polymeric mordant.

More preferably, the ink-receptive sheet comprises a transparent substrate bearing an ink-receptive layer comprising a crosslinked semi-interpenetrating network, hereinafter referred to as an SIPN, formed from polymer blends comprising a) at least one crosslinkable polymeric component, b) at least one liquid-absorbent polymer comprising a water-absorbent polymer, and c) optionally, a crosslinking agent.

The SIPNs are continuous networks wherein the crosslinked polymer forms a continuous matrix. The SIPN is generated by crosslinking a copolymer containing from about 3 to about 20% ammonium acrylate groups with a crosslinking agent and then combining the copolymer with a liquid absorbent polymer or an uncrosslinked blend of the same polymer in combination with the polymeric mordant described, supra.

This invention provides an ink-receptive sheet useful for imaging with various commercially available ink-jet printers. Preferred embodiments provide a transparent ink-receptive sheet useful for projecting an image, commonly called a "transparency" which, when imaged with an ink depositing device has reduced image bleeding, and improved shelf life, even when it is exposed to elevated temperature and high humidity, or in cases where solvent is prevented from leaving the coating, e.g., when stored in a transparency protector.

Most preferably, the ink-receptive sheets of the invention comprise a transparent substrate bearing on at least one major surface thereof an ink-receptive layer comprising:

a) at least one polymeric crosslinkable matrix component, b) at least one polymeric liquid-absorbent component, c) a polyfunctional aziridine crosslinking agent, d) a polymeric mordant containing a guanidine functionality having the following structure:

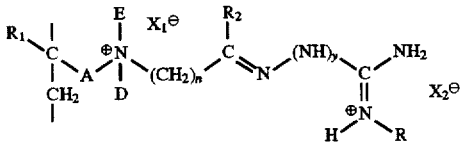

wherein

A is selected from the group consisting of a COO-alkylene group having from 1 to about 5 carbon atoms, a CONH-alkylene group having from 1 to about 3 carbon atoms, —COO—$(CH_2CH_2O)$n—$CH_2$—, —CONH—$(CH_2CH_2O)$n—$CH_2$—, and $(CH_2—CH_{2NH2}Cl)$n wherein n is from 1 to about 5;

B and D are separately selected from the group consisting of alkyl group having from 1 to about 3 carbon atoms;

or A, E, D and N are combined to form a heterocyclic compound selected from the group consisting of

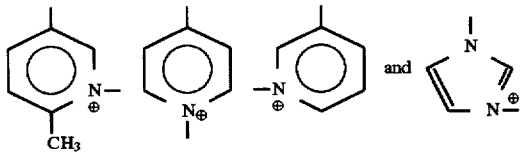

$R_1$ and $R_2$ are independently selected from the group consisting of hydrogen, phenyl, and an alkyl group containing from 1 to about 3 carbon atoms;

R is selected from the group consisting of hydrogen, phenyl, benzimidazolyl, and an alkyl group containing from to about 3 carbon atoms, y is selected from the group consisting of 0 and 1, and $X_1$ and $X_2$ are anions; and e) a particulate material having a particle size distribution ranging from the about 5 μm to about 40 μm.

In another embodiment of the invention, the image recording sheet comprises a substrate bearing on at least one major surface a two layer structure comprising a) a liquid sorbing underlayer layer comprising and overlying said under layer, b) a liquid-permeable surface layer, the liquid sorbtivity of said underlayer being greater then the liquid sorptivity of said surface layer whereby the composite medium has a sorption time less than the sorption time of a thickness of said surface layer equal to the thickness of the composite, wherein at least one layer comprises a mordant having the following general formula:

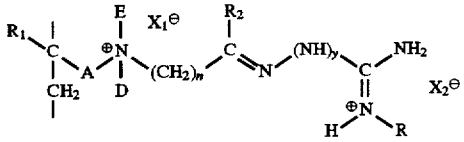

wherein

A is selected from the group consisting of a COO-alkylene group having from 1 to about 5 carbon atoms, a CONH-alkylene group having from 1 to about 3 carbon atoms, —COO—$(CH_2CH_2O)$n—$CH_2$—, —CONH—$(CH_2CH_2O)$n—$CH_2$—, and $-(CH_2—CH_2—NH_2Cl-)$n wherein n is from 1 to about 5;

E and D are separately selected from the group consisting of alkyl group having from 1 to about 5 carbon atoms;

or A, E, D and N are combined to form a heterocyclic compound selected from the group consisting of

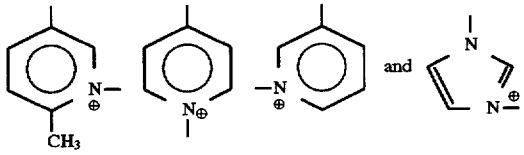

$R_1$ and $R_2$ are independently selected from the group consisting of hydrogen, phenyl, and an alkyl group containing from 1 to about 3 carbon atoms;

R is selected from the group consisting of hydrogen, phenyl, benzimidazolyl, and an alkyl group containing from 1 to about 3 carbon atoms, y is selected from the group consisting of 0 and 1, and $X_1$ and $X_2$ are anions; and c) a particulate material having a particle size distribution ranging from the about 5 μm to about 40 μm.

When used herein, these terms have the following meanings:

1. The term "mordant" means a compound which, when present in a composition, interacts with a dye to prevent diffusion through the composition.
2. The term "SIPN" means a semi-interpenetrating network.
3. The term "semi-interpenetrating network" means an entanglement of a homocrosslinked polymer with a linear uncrosslinked polymer.
4. The term "crosslinkable" means capable of forming covalent or strong ionic bonds with itself or with a separate agent added for this purpose.
5. The terms "hydrophilic" and "hydrophilic surface" are used to describe a material that is generally receptive to water, either in the sense that its surface is wettable by water or in the sense that the bulk of the material is able to absorb significant quantities of water. Materials that exhibit surface wettability by water have hydrophilic surfaces.
6. The term "hydrophilic liquid-absorbing materials" means materials that are capable of absorbing significant quantities of water, aqueous solutions, including those materials that are water-soluble. Monomeric units will be referred to as hydrophilic units if they have a water-sorption capacity of at least one mole of water per mole of monomeric unit.

7. The terms "hydrophobic" and "hydrophobic surface" refer to materials which have surfaces not readily wettable by water. Monomeric units will be referred to as hydrophobic if they form water-insoluble polymers capable of absorbing only small amounts of water when polymerized by themselves.

All parts, percents, and ratios herein are by weight unless otherwise noted.

DETAILED DESCRIPTION OF THE INVENTION

Mordants useful in ink-receptive sheets of the invention contain at least one guanidine functionality having the following general structure:

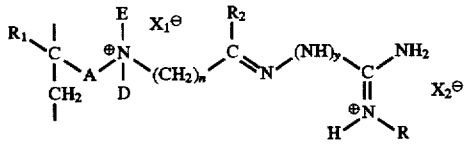

wherein

A is selected from the group consisting of a COO-alkylene group having from 1 to about 5 carbon atoms, a CONH-alkylene group having from 1 to about 5 carbon atoms, —COO—$(CH_2CH_2O)$n —$CH_2$—, —CONH—$(CH_2CH_2O)$n—$CH_2$—, and —($CH_2$—$CH_2$—$NH_2Cl$—)n wherein n is from 1 to about 5, preferably from 1 to about 3;

E and D are independently selected from the group consisting of alkyl group having from 1 to about 5 carbon atoms, preferably from 1 to about 3 carbon atoms;

or A, E, D and N are combined to form a ring compound selected from the group consisting of

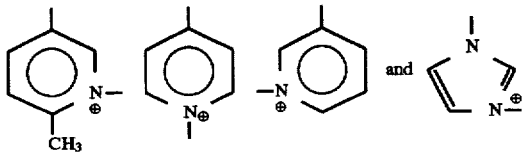

$R_1$ and $R_2$ are independently selected from the group consisting of hydrogen, phenyl, and an alkyl group containing from 1 to about 5 carbon atoms, preferably from 1 to about 3 carbon atoms, R is selected from the group consisting of hydrogen, phenyl, benzimidazolyl, and an alkyl group containing from 1 to about 5 carbon atoms, preferably from 1 to about 3 carbon atoms, y is selected from the group consisting of 0 and 1, and $X_1$ and $X_2$ are anions.

Preferred classes of mordants include the following classes:

Class A, which das a structure as follows:

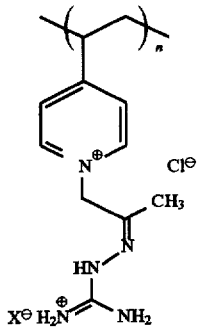

wherein

X represents $CH_3SO_3$, Br, $NO_3$, Cl, $CF_3COO$, p-$MePhSO_3$, $ClO_4$, F, $CF_3SO_3$, $BF_4$, $C_4F_9SO_3$, $FSO_3$, $PF_6$, $ClSO_3$, or $SbF_6$; and n represents an integer of 2 or greater;

Class B, which has the structure:

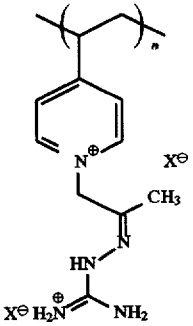

wherein

X represents $CH_3SO_3$, p-$MePhSO_3$, $CF_3SO_3$, $BF_4$, $PF_6$, or $SbF_6$; and n represents an integer of 2 or greater.

Class C, which has the structure:

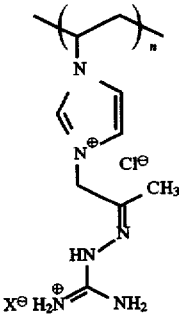

wherein

X represents $CH_3SO_3$, Br, $NO_3$, Cl, $CF_3COO$, p-$MePhSO_3$, $Cl_4$, F, $CF_3SO_3$, $BF_4$, $C_4F_9SO_3$, $FSO_3$, $PF_6$, $ClSO_3$, or $SbF_6$; and n represents an integer of 2 or greater;

Class D, which has the structure:

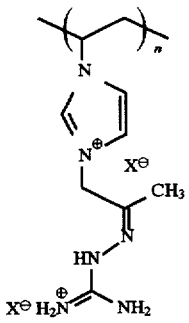

wherein

X represents $CH_3SO_3$, p-$MePhSO_3$, $CF_3SO_3$, $BF_4$, $PF_6$, or $SbF_6$; and n represents an integer of 2 or greater;

Class F, which has the structure:

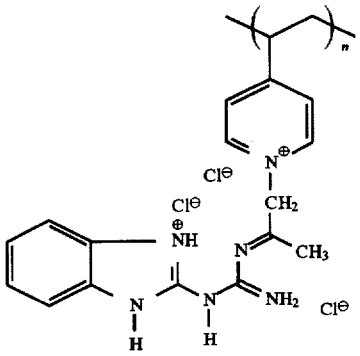

wherein n represents an integer of 2 or greater;

Class F which has the following structure:

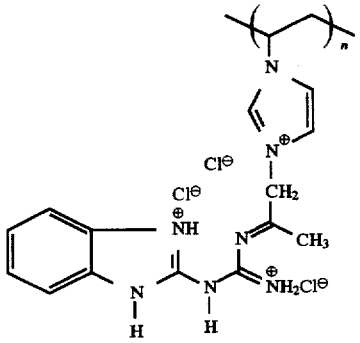

wherein n represents an integer of 2 or greater;

Class G which has the structure:

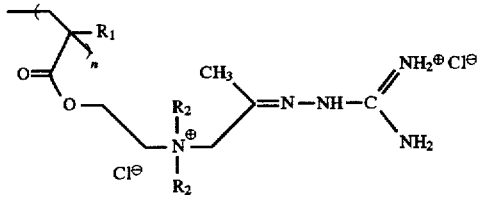

wherein $R_1$ represents H or $CH_3$; $R_2$ represents a $C_{1-C4}$ alkyl group, and n represents an integer of 2 or greater.

Class H which has the structure:

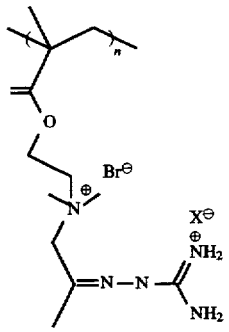

wherein

X is selected from the group consisting of $Cl^-$, $CF_3COO^-$, phenyl-$CH_3SO_3^-$, $BF_4^-$, $CH_3SO_3^-$, $NO_2^-$, $Br^-$ and $CF_3SO_3^-$, and n represents an integer of 2 or greater.

Class I which has the structure:

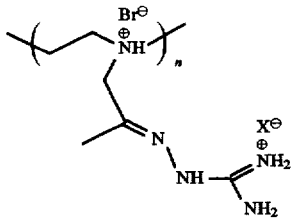

wherein X is selected from the group consisting of $Cl^-$, $CF_3COO^-$, phenyl-$CH_3SO_3^-$, $BF_4^-$, $CH_3SO_3^-$, $NO_2^-$, $Br^-$ and $CF_3SO_3^-$, and n represents an integer of 2 or greater.

Preferred mordants are those which have a molecular weight of less than about 200,000, most preferably 10,000 to about 60,000.

The ink-receptive layer of the improved ink-receptive sheet of the invention further comprises a polymeric ink-receptive material. Although at least one of the polymers present in the polymeric ink-receptive material is preferably crosslinkable, the system need not be crosslinked to exhibit the improved longevity and reduced bleeding. Such crosslinked systems have advantages for dry time, as disclosed in U.S. Pat. No. 5,134,198 (Iqbal), incorporated herein by reference.

Preferably the ink-receptive layer comprises a polymeric blend containing at least one water-absorbing, hydrophilic, polymeric material, and at least one hydrophobic polymeric material incorporating acid functional groups. Sorption capacities of various monomeric units are given, for example, in D. W. Van Krevelin, with the collaboration of P. J. Hoftyzer, Properties of Polymers: Correlations with Chemical Structure, Elsevier Publishing Company (Amsterdam, London, New York, 1972), pages 294–296.

The water-absorbing hydrophilic polymeric material comprises homopolymers or copolymers of monomeric units selected from vinyl lactams, alkyl tertiary amino alkyl acrylates or methacrylates, alkyl quaternary amino alkyl acrylates or methacrylates, 2-vinylpyridine and 4-vinylpyridine. Polymerization of these monomers can be conducted by free-radical techniques with conditions such as time, temperature, proportions of monomeric units, and the like, adjusted to obtain the desired properties of the final polymer.

Hydrophobic polymeric materials are preferably derived from combinations of acrylic or other hydrophobic ethylenically unsaturated monomeric units copolymerized with monomeric units having acid functionality. The hydrophobic monomeric units are capable of forming water-insoluble polymers when polymerized alone, and contain no pendant alkyl groups having more than 10 carbon atoms. They also are capable of being copolymerized with at least one species of acid-functional monomeric unit.

Preferred hydrophobic monomeric units are selected from certain acrylates and methacrylates, e.g., methyl(meth) acrylate, ethyl(meth)acrylate, acrylonitrile, styrene or α-methylstyrene, and vinyl acetate. Preferred acid functional monomeric units for polymerization with the hydrophobic monomeric units are acrylic acid and methacrylic acid in amounts of from about 2% to about 20%.

When desired, a polyethylene glycol can be added to the ink-receptive layer for the purpose of curl reduction. Lower molecular weight polyethylene glycols are more effective for reducing curl while maintaining a low level of haze. Accordingly, it is preferred that the polyethylene glycol have a molecular weight of less than 4000.

In a preferred embodiment, the ink-receptive coating is an SIPN. The SIPN of the present invention comprises crosslinkable polymers that are either hydrophobic or hydrophilic in nature, and can be derived from the copolymerization of acrylic or other hydrophobic or hydrophilic ethylenically unsaturated monomeric units with monomers having acidic groups, or if pendant ester groups are already present in these acrylic or ethylenically unsaturated monomeric units, by hydrolysis.

Hydrophobic monomeric units suitable for preparing crosslinkable matrix components are preferably selected from:

(1) acrylates and methacrylates having the structure:

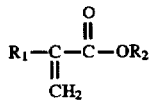

wherein $R_1$ represents H or —$CH_3$, and $R_2$ represents an alkyl group having up to ten carbon atoms, preferably up to four carbon atoms, and more preferably one to two carbon atoms, a cycloaliphatic group having up to nine carbon atoms, a substituted or unsubstituted aryl group having up to 14 carbon atoms, and an oxygen containing heterocyclic group having up to ten carbon atoms;

(2) acrylonitrile or methacrylonitrile;

(3) styrene or α-methylstyrene having the structure:

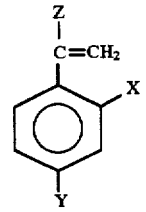

where X and Y independently represent hydrogen or alkyl groups having up to 4 carbon atoms, preferably 1 or 2 carbon atoms, a halogen atom, alkyl halide group, or $OR_m$ where $R_m$ represent hydrogen or an alkyl group having up to 4 carbon atoms, preferably 1 or 2 carbon atoms, and Z represents hydrogen or methyl; and (4) vinyl acetate.

Hydrophilic monomeric units suitable for preparing crosslinkable polymers are preferably selected from:

(1) vinyl lactams having the repeating structure:

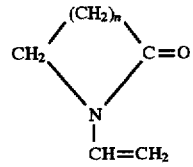

where n represents the integer 2 or 3;

(2) acrylamide or methacrylamide having the structure:

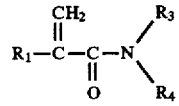

where $R_1$ is as defined previously, $R_3$ represents H or an alkyl group having up to ten carbon atoms, preferably from one to four carbon atoms, and $R_4$ represents H or an alkyl group, having up to ten carbon atoms, preferably from one to four carbon atoms, or an hydroxyalkyl group, or an alkoxy alkyl group having the structure of where p represents an integer from 1 to 3, inclusive;

(3) tertiary amino alkylacrylates or tertiary amino alkylmethacrylates having the structure:

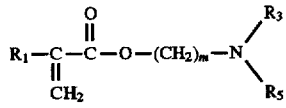

where m represents the integer 1 or 2 and $R_1$ and $R_3$ are as defined previously, and $R_5$ represents an alkyl group having up to ten carbon atoms, preferably from one to four carbon atoms;

(4) hydroxy alkylacrylates, alkoxy alkylacrylates, hydroxy alkyl methacrylates, or alkoxy alkyl methacrylates having the structure:

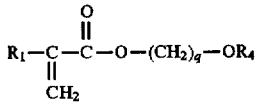

where $R_1$ and $R_4$ are as defined previously, q represents an integer from 1 to 4, inclusive, preferably 2 to 3; and (5) alkoxy acrylates or alkoxy methacrylates having the structure:

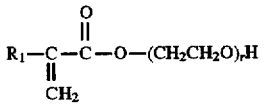

where r represents an integer from 5 to 25, inclusive, and $R_1$ is defined previously.

Some of the previously mentioned structures of both the hydrophobic and hydrophilic monomeric units contain pendant ester groups that can readily be rendered crosslinkable by hydrolysis. For the others, monomeric units containing acidic groups are incorporated into the polymeric structure to render them crosslinkable. Polymerization of these monomers can be carried out by typical free radical solution, emulsion, or suspension polymerization techniques. Suitable monomeric units containing acidic groups include acrylic acid or methacrylic acid, other copolymerizable carboxylic acids, and ammonium salts.

The crosslinking agent is preferably selected from the group of polyfunctional aziridines possessing at least two crosslinking sites per molecule, such as trimethylol propane-tris-(β-(N-aziridinyl)propionate)

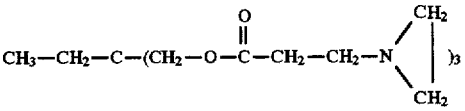

pentaerythritol-tris-(β-(N-aziridinyl)propionate)

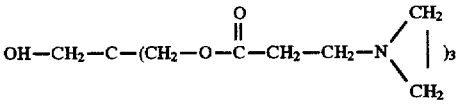

trimethylolpropane-tris-(β(N-methylaziridinyl propionate), and so on.

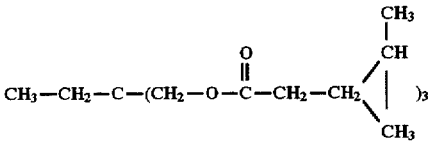

Crosslinking can also be brought about by means of metal ions, such as provided by multivalent metal ion salts, provided the composition containing the crosslinkable polymer is made from 80 to 99 parts by weight of monomer and from 1 to 20 parts by weight of a chelating compound.

The metal ions can be selected from ions of the following metals: cobalt, calcium, magnesium, chromium, aluminum, tin, zirconium, zinc, nickel, and so on, with the preferred compounds being selected from aluminum acetate, aluminum ammonium sulfate dodecahydrate, alum, aluminum chloride, chromium (III) acetate, chromium (III) chloride hexahydrate, cobalt acetate, cobalt (II) chloride hexahydrate, cobalt (II) acetate tetrahydrate, cobalt sulfate hydrate, copper sulfate pentahydrate, copper acetate hydrate, copper chloride dihydrate, ferric chloride hexahydrate, ferric ammonium sulfate dodecahydrate, ferrous chloride, tetrahydrate, magnesium acetate tetrahydrate, magnesium chloride hexahydrate, magnesium nitrate hexahydrate, manganese acetate tetrahydrate, manganese chloride tetrahydrate, nickel chloride hexahydrate, nickel nitrate hexahydrate, stannous chloride dihydrate, stannic chloride, tin (II) acetate, tin (IV) acetate, strontium chloride hexahydrate, strontium nitrate, zinc acetate dihydrate, zinc chloride, zinc nitrate, zirconium (IV) chloride, zirconium acetate, zirconium oxychloride, zirconium hydroxychloride, ammonium zirconium carbonate, and so on.

The preferred chelating compounds can be selected from:

(1) alkaline metal salts of acrylic or methacrylic acid having the structure:

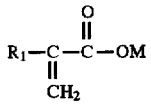

where $R_1$ is described previously and M represents Li, Na, K, Rb, Cs, or $NH_4$, preferably $NH_4$, Na, or K;

(2) N-substituted acrylamido or methacrylamido monomers containing ionic groups having the structure:

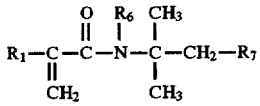

where $R_1$ is described previously, $R_6$ represents H or an alkyl group having up to four carbon atoms, preferably H, $R_7$ represents COOM or $—SO_3M$ where M is described previously;

(3) alkali metal salt of p-styrene sulfonic acid;

(4) sodium salt of 2-sulfo ethyl acrylate and sodium salt of 2-sulfo ethyl methacrylate;

(5) 2-vinyl pyridine and 4-vinyl pyridine;

(6) vinyl imidazole;

(7) N-(3-aminopropyl) methacrylamide hydrochloride; and (8) 2-acetoacetoxy ethyl acrylate and 2-acetoacetoxy ethyl methacrylate.

Other crosslinkable polymers suitable for the matrix component of the hydrophilic SIPNs of the present invention are polymers having crosslinkable tertiary amino groups, wherein said groups can be provided either as part of the monomeric units used in the formation of the polymer, or grafted onto the polymer after the formation of the polymeric backbone. These have the general structure of:

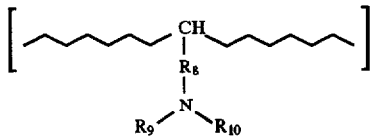

wherein $R_8$ represents a member selected from the group consisting of substituted and unsubstituted alkyl groups, substituted and unsubstituted amide groups, and substituted and unsubstituted ester groups, the foregoing groups preferably having no more than ten carbon atoms, more preferably having no more than five carbon atoms, substituted and unsubstituted aryl groups, preferably having no more than 14 carbon atoms, $R_9$ and $R_{10}$ independently represent a member selected from the group consisting of substituted and unsubstituted alkyl groups, preferably having no more than ten carbon atoms, more preferably having no more than five carbon atoms, and substituted and unsubstituted aryl groups, preferably having no more than 14 carbon atoms. Additionally, $R_9$ and $R_{10}$ can be connected to form the substituted or unsubstituted cyclic structure $—R_9—R_{10}—$.

Where water or other aqueous liquids are to be absorbed, it is preferred that $R_8$ be selected to be $—(C{=}O)NH(R_{11})—$, wherein $R_{11}$ represents a substituted or unsubstituted divalent alkyl group, preferably having no more than ten carbon atoms, and more preferably having no more than five carbon atoms. Preferred substituents for are those capable of hydrogen bonding, including —COOH, —CN, and $—NO_2$. Additionally, $R_{11}$ can include in its structure hydrogen bonding groups, such as —CO—, >S=O, —O—, >N—, —S—, and >P—.

Crosslinkable polymers suitable for the matrix component wherein $R_8$ is $—(C{=}O)NH(R_{11})$ — can be prepared by treating polymers or copolymers containing maleic anhydride, with an amine having the structure:

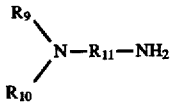

wherein, $R_9$, $R_{10}$, and $R_{11}$ are as described previously.

A particularly useful example of a crosslinkable matrix component is derived from a copolymer of polymethyl vinyl ether and maleic anhydride, wherein these two monomeric units are present in approximately equimolar amounts. This copolymer can be formed in the following manner:

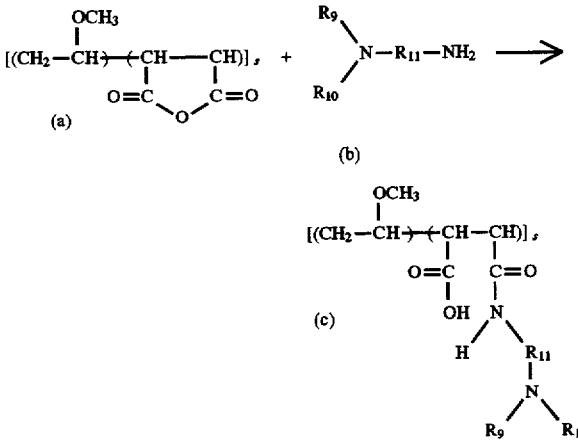

wherein $R_9$, $R_{10}$, and $R_{11}$ are as described previously, and s preferably represents a number from about 100 to about 600. This reaction can be conveniently performed by dissolving the polymethyl vinyl ether/maleic anhydride copolymer, i.e., reactant (a), in methyl ethyl ketone, dissolving the amine, i.e., reactant (b), in an alcohol, such as methanol or ethanol, and mixing the two solutions. This reaction proceeds rapidly at room temperature, with agitation. The product of this reaction may begin to form a cloudy suspension, which can be cleared by the addition of water to the solution.

Crosslinking agents suitable for this type of polymer are multi-functional alkylating agents, each functional group of which forms a bond with a polymer chain through a tertiary amino group by quaternization of the trivalent nitrogen of the tertiary amino group. Difunctional alkylating agents are suitable for this purpose. In the case where the tertiary amino group is pendant to the backbone of the polymer, this crosslinking reaction can be depicted as follows:

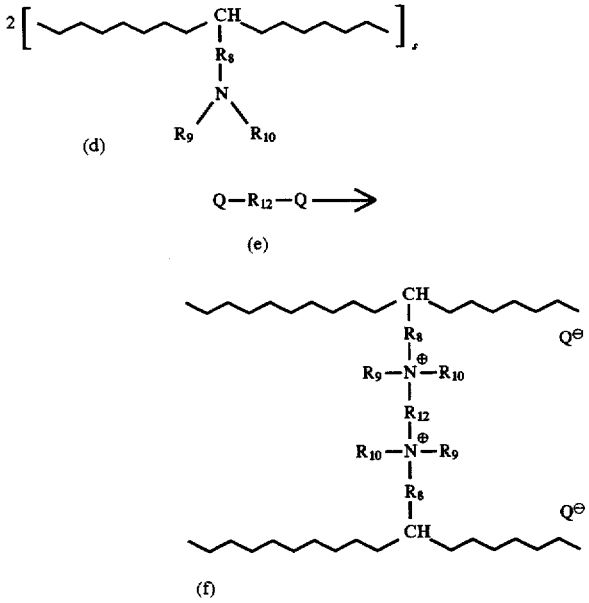

where $R_8$, $R_9$, $R_{10}$, and s are as described previously, $R_{12}$ can be the same as $R_8$, $R_9$, or $R_{10}$, and $Q^-$ can be a halide, an alkyl sulfonate, preferably having no more than 5 carbon 0 atoms, or any aryl sulfonate, preferably having no more than 14 carbon atoms.

Still other crosslinkable polymers suitable for forming the matrix component of the SIPNs of the present invention include polymers having silanol groups, wherein the silanol groups can either be part of the monomeric units used in the formation of the polymer or be grafted onto the polymer after the formation of the polymeric backbone. If grafting is preferred, the polymeric backbones generally contain monomeric units of maleic anhydride, which can be converted into graftable sites by reaction with compounds having primary amino groups. Silanol side groups can be grafted onto these sites by heating a solution containing the backbone polymer with an aminoalkoxysilane. The alkoxysilane can subsequently be hydrolyzed by the addition of water. The reaction scheme can be depicted as follows:

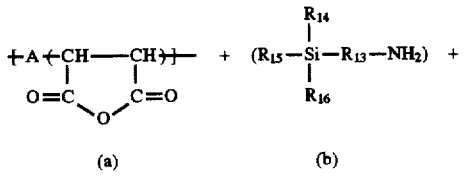

-continued

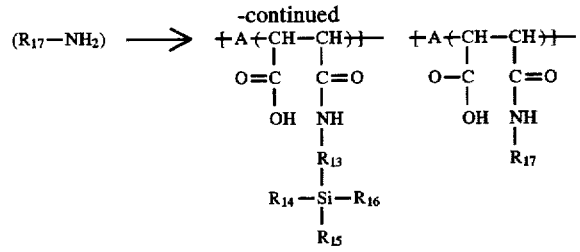

(c) (d)

wherein

A represents a monomeric unit preferably selected from the group consisting of acrylonitrile, allyl acetate, ethylene, methyl acrylate, methyl methacrylate, methyl vinyl ether, stilbene, isostilbene, styrene, vinyl acetate, vinyl chloride, vinylidene chloride, vinylpyrrolidone, divinylether, norbornene, and chloroethyl vinyl ether;

$R_{13}$ represents a divalent alkyl group, preferably having up to ten carbon atoms, more preferably having not more than five carbon atoms; $R_{14}$, $R_{15}$, and $R_{16}$ independently represent alkoxy groups having up to about five carbon atoms, more preferably having not more than about three carbon atoms; and $R_{17}$ represents a member selected from the group consisting of substituted or unsubstituted alkyl groups, preferably having up to ten carbon atoms, more preferably having not more than five carbon atoms, and substituted or unsubstituted aryl groups, preferably having up to 14 carbon atoms.

Suitable substituents for $R_1$ 7 include alkoxy, —OH, —COOH, —COOR, halide, and —$NR_2$, wherein R represents an alkyl group, preferably having up to five carbon atoms, more preferably having not more than three carbon atoms.

The relative amounts of the two types of side groups in polymer (d) are determined by the relative amounts of compounds (b) and (c) used in the grafting solutions. The molar ratio of compound (c) to compound (b) in the reaction ranges from about 3 to about 6, preferably from about 4 to about 5.

A discussion of the copolymerization of these monomeric units with maleic anhydride and the properties of the resulting copolymers can be found in Brownell, G. L., "Acids, Maleic and Fumaric," in *Encyclopedia of Polymer Science and Technology*, Vol. 1, John Wiley & Sons, Inc., (New York:1964), pp. 67–95.

Once the silanol groups are formed by hydrolysis, the resulting polymer can be crosslinked by the removal of water and other solvents from the system without addition of further crosslinking agent, according to the reaction:

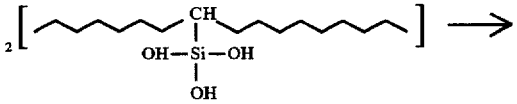

-continued

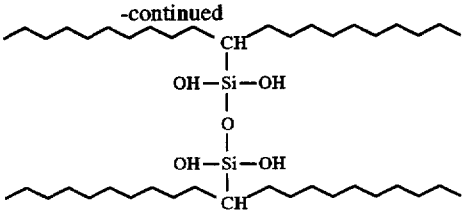

Additionally, crosslinking can occur at more than one of the —OH groups attached to the silicon atom.

Still another type of crosslinkable polymer that is suitable for forming the matrix component of the SIPNs of the present invention includes polymers bearing groups capable of preventing gelation of a coating solution containing the crosslinkable polymer and the liquid-absorbent polymer after the crosslinkable polymer is crosslinked in solution but before the solution is coated onto a substrate and dried. These polymers generally contain maleic anhydride units, which function as sites for grafting of the gelation-preventing groups. The gelation-preventing groups are monofunctional oligomers that not only react with the maleic anhydride units of the polymer but are also highly soluble in solvent media used to coat the SIPNs onto substrates. Typical of such oligomeric materials are monofunctional polyoxy-alkyleneamines such as the Jeffamine™ series of oligomers manufactured by the Texaco Chemical Company and having the general formula:

Oligomer-$NH_2$ where "Oligomer" represents:

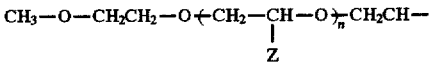

wherein Z represents —H or —$CH_3$, and n represents a number such that the molecular weight of the oligomer can range from 200 to 3000.

The reaction scheme in which the crosslinked polymer is formed can be depicted as follows:

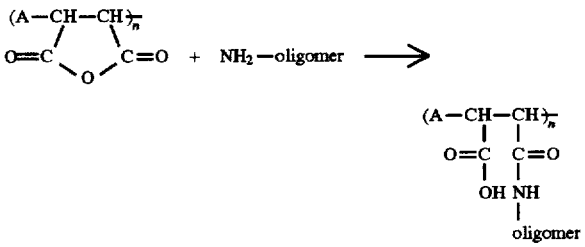

where A is as previously defined.

The percentage of maleic anhydride units reacted in the reaction typically ranges from about 2 to about 85 percent, preferably from 5 to 20 percent, of the total number of maleic anhydride units present in the polymer. This polymer can be crosslinked by reaction with tertiary alkanolamines having two or more hydroxyalkyl substituents, such as triethanolamine, tetrahydroxyethylethylenediamine, methyl-bis-hydroxyethylamine, tetrahydroxyethylpropylenediamine, or N,N,N',N'-tetrahydroxyethyl-2-hydroxy-1,3-propanediamine.

The crosslinking reaction can be depicted as follows:

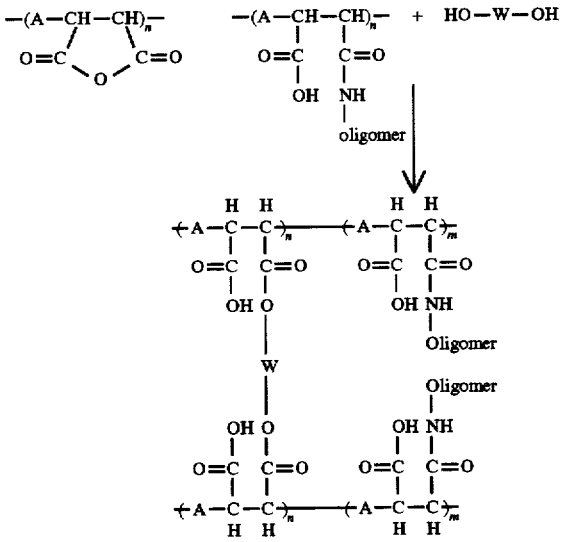

where W represents the tertiary aminoalkyl moiety derived from the crosslinking agent and n/m represents the ratio of unreacted maleic anhydride units to maleic anhydride units reacted with the oligomer containing the gelation-preventing groups.

The amount of crosslinking agent to be used is preferably that amount that will react with 5 to 150 mole percent, preferably 25 to 90 percent, of the unreacted anhydride units of the polymer that forms the matrix. When the crosslinking agent is added in an amount capable of reacting with more than 100 mole percent of the unreacted maleic anhydride units, unreacted hydroxyalkyl moieties will remain as part of the crosslinked product.

While it is the primary function of the crosslinkable component of the SIPN to impart physical integrity and durability to the SIPN without adversely affecting the overall liquid absorbency of the SIPN, it is the primary function of the liquid-absorbent component to promote absorption of liquids. When aqueous liquids are to be absorbed, as is in the case of most inks, the liquid-absorbent component must be capable of absorbing water, and preferably be water-soluble. The liquid-absorbent component can be selected from polymers formed from the following monomers:

(1) vinyl lactams having the repeating structure:

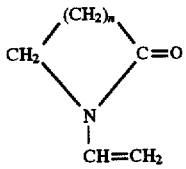

where n is from 1 to about 5;

(2) alkyl tertiary amino alkylacrylates and alkyl tertiary amino alkylmethacrylates having the structure:

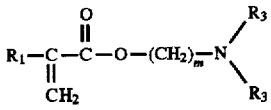

where m, $R_1$ and $R_3$ are as described previously;

(3) alkyl quaternary amino alkylacrylates or alkyl quaternary amino alkyl methacrylates having the structure:

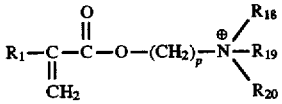

where p represents the integer 1 or 2; and $R^1$ is as described previously, $R_{18}$, $R_{19}$, $R_{20}$ independently represent hydrogen or an alkyl group having up to 10 carbon atoms, 25 preferably having from 1 to 6 carbon atoms, and Q represents a halide, $R_{18}SO_4$, $R_{19}SO_4$, or $R_{20}SO_4$.

Polymerization of these monomers can be carried out by conventional free radical polymerization techniques as mentioned previously.

Alternately, the liquid-absorbent component can be selected from commercially available water-soluble or water-swellable polymers such as polyvinyl alcohol, polyvinyl alcohol/poly(vinyl acetate) copolymer, poly(vinyl formal) or poly(vinyl butyral), gelatin, carboxy methylcellulose, hydroxyethyl cellulose, hydroxypropyl cellulose, hydroxyethyl starch, poly(ethyl oxazoline), poly (ethylene oxide), poly(ethylene glycol), poly(propylene oxide), and so on. The preferred polymers are poly(vinyl lactams), especially poly(vinyl pyrrolidone), and poly(vinyl alcohol).

SIPNs to be used for forming ink-receptive layers of the present invention typically comprise from about 0.5 to 6.0 percent crosslinking agent, preferably from about 1.0 to 4.5 percent, when crosslinking agents are needed. The crosslinkable polymer can comprise from about 25 to about 99 percent, preferably from about 30 to about 60 percent of the total SIPNs. The liquid-absorbent component can comprise from about 1 to about 75 percent, preferably from about 40 to about 70 percent of the total SIPNs.

The ink-receptive layer can also include particulate material for the purpose of improving handling and flexibility. Preferred particulate materials include polymeric beads, e.g., poly(methylmethacrylate), poly(stearyl methacrylate) hexanedioldiacrylate copolymers, poly(tetrafluoroethylene), polyethylene; starch and silica. Poly(methylmethacrylate) beads are most preferred. Levels of particulate are limited by the requirement that the final coating be transparent with a haze level of 15% or less, as measured according to ASTM D1003-61 (Reapproved 1979). The preferred mean particle diameter for particulate material is from about 5 to about 40 micrometers, with at least 25% of the particles having a diameter of 15 micrometers or more. Most preferably, at least about 50% of the particulate material has a diameter of from about 20 micrometers to about 40 micrometers.

The ink-receptive layer can also include other additives to improve image quality such as alumina sols and silica sols, and other conventional adjuvants.

The ink-receptive formulation can be prepared by dissolving the components in a common solvent. Well-known methods for selecting a common solvent make use of Hansen parameters, as described in U.S. Pat. No. 4,935,307, incorporated herein by reference.

The ink-receptive layer can be applied to the film backing by any conventional coating technique, deposition from a solution or dispersion of the resins in a solvent or aqueous medium, or blend thereof, by means of such processes as Meyer bar coating, knife coating, reverse roll coating, rotogravure coating, and the like.

Drying of the ink-receptive layer can be effected by conventional drying techniques, e.g., by heating in a hot air oven at a temperature appropriate for the specific film backing chosen. For example, a drying temperature of about 120° C. is suitable for a polyester film backing.

An alternative embodiment of the present invention is a two-layer composite medium for sorbing liquids which is imageable. In this embodiment, an ink-permeable protective layer is applied atop the ink-receptive layer to form a composite medium for sorbing liquids. In this embodiment, either layer of the composite medium may contain the mordant, or mordant may be contained in both layers. If mordant is contained in both layers, the mordants may be the same or different.

The ink-receptive layer will typically have greater liquid sorptivity than that of the surface layer whereby the composite medium has a sorption time less than the sorption time of a thickness of the surface layer equal to the thickness of the composite.

The liquid sorptivity can be tested by a "sorption time" or "dry time" test or other analogous tests such as those disclosed in U.S. Pat. No. 4,379,804, incorporated herein by reference.

Preferred materials for an ink-permeable layer include polyvinyl alcohol, polyvinyl pyrrolidone, cellulose acetate/butyrate, gelatin, polyvinyl acetate and mixtures thereof. Polyvinyl alcohol is the most preferred material.

Additives can also be incorporated into the ink-permeable protective layer to improve processing, including, xanthan gum, added to improve coatability, and particulates to improve feedability, and alumina or silica sols added to improve image quality.

Other suitable materials for the protective layer are disclosed in U.S. Pat. Nos. 4,225,652, 4,301,195, and 4,379,804, all of which are incorporated herein by reference.

The composition for the protective layer is preferably prepared by dispersing finely divided polyvinyl alcohol in cold water, agitating the dispersion vigorously, and then gradually heating the dispersion by an external source or by a direct injection of steam. After cooling the dispersion to room temperature, particulate material can be mixed into the dispersion using conventional propeller type power-driven apparatus.

Methods for applying the protective layer are conventional coating methods such as those described, supra.

Film backings may be formed from any polymer capable of forming a self-supporting sheet, e.g., films of cellulose esters such as cellulose triacetate or diacetate, polystyrene, polyamides, vinyl chloride polymers and copolymers, polyolefin and polyallomer polymers and copolymers, polysulphones, polycarbonates and polyesters as well as vinyl, Surlyn®, available from Monsanto, Tyvek®, polypropylene nonwoven film, and Teslin®, a nonwoven polyolefin film available from Pittsburg Paint and Glass.

While transparent backings are preferred, especially where applications such as image projection are desired, the scope of this invention includes the use of opaque backings such as vinyl, nontransparent polyolefins and the like. These opaque backings are especially useful in larger format applications such as those for advertising on signs, buildings, panels for motor vehicles and the like, but may also be useful in office sized format for presentations where projection is not required, indoor advertisements, placards, brochures and the like.

Suitable polyester films may be produced from polyesters obtained by condensing one or more dicarboxylic acids or their lower alkyl diesters in which the alkyl group contains up to about 6 carbon atoms, e.g., terephthalic acid, isophthalic, phthalic, 2,5-,2,6-, and 2,7-naphthalene dicarboxylic acid, succinic acid, sebacic acid, adipic acid, azelaic acid, with one or more glycols such as ethylene glycol, 1,3-propanediol, 1,4-butanediol, and the like.

Preferred film backings are the transparent films such as cellulose triacetate or cellulose diacetate, polyesters, especially poly(ethylene terephthalate), and polystyrene films. Poly(ethylene terephthalate) is most preferred. It is preferred that film backings have a caliper ranging from about 50 micrometers to about 125 micrometers. Film backings having a caliper of less than about 50 micrometers are difficult to handle using conventional methods for graphic materials. Film backings having calipers over 125 micrometers are very stiff, and present feeding difficulties in certain commercially available ink jet printers and pen plotters.

When polyester or polystyrene films supports are used, they are preferably biaxially oriented, and may also be heat set for dimensional stability during fusion of the image to the support. These films may be produced by any conventional method in which the film is biaxially stretched to impart molecular orientation and is dimensionally stabilized by heat setting.

To promote adhesion of the ink-receptive layer to the film backing, it may be desirable to treat the surface of the film backing with one or more primers, in single or multiple layers. Useful primers include those known to have a swelling effect on the film backing polymer. Examples include halogenated phenols dissolved in organic solvents. Alternatively, the surface of the film backing may be modified by treatment such as corona treatment or plasma treatment.

The primer layer, when used, should be relatively thin, preferably less than 2 micrometers, most preferably less than 1 micrometer, and may be coated by conventional coating methods.

Where desired, the opposing surface of the substrate to the imaging surface may be coated with an adhesive in order to facilitate attachment to a bulletin board, billboard or the like or use of an opaque sheet to form an ink-receptor composite. The adhesive may cover only a portion, or the entire opposing major surface may be coated therewith. Useful adhesives are conventional adhesives including such non-limiting examples as hot melt adhesives, rubber adhesives, block copolymer adhesives, pressure-sensitive adhesives, acrylate adhesives, repositionable microsphere adhesives and the like.

Where an adhesive is coated onto ink-receptive sheets of the invention, an additional sheet, known as a "low adhesion backsize" may also be present. The purpose of such a sheet, is to cover and protect the adhesive, until such time as it is desirable to expose the adhesive for attachment. The sheet may be comprised of any material, such as a film or paper, which has a low adhesion to the particular adhesive chosen, or it may be coated with a release material such as a silicone.

Transparent ink-receptive sheets of the invention or "transparencies" are particularly useful in the production of imaged transparencies for viewing in a transmission mode, e.g., in association with an overhead projector.

The following examples are for illustrative purposes, and do not limit the scope of the invention, which is that defined by the claims.

GLOSSARY OF MORDANTS

P144

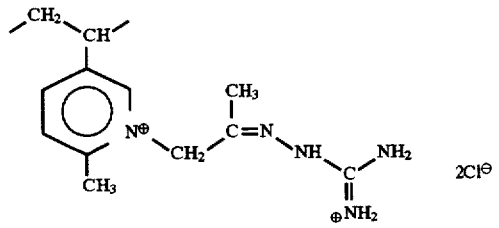

P134-Class A mordant wherein the anion, $X^-$, is $CF_3SO3^-$ When another anion is used, the designation will be followed by the identity of the anion.

I224-Class C mordant wherein $X^-$, is $CF_3SO_3^-$. When another anion is used, the designation will be followed by the anion.

MA1-CMA1-$Cl^-$

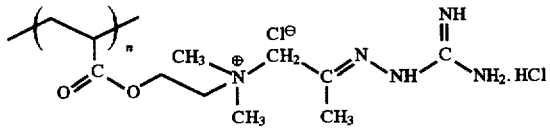

P124

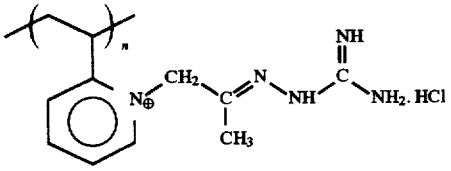

F-71 Class H mordant wherein $X^-$ is $Cl^-$. When another anion is used, the designation will be followed by the anion.

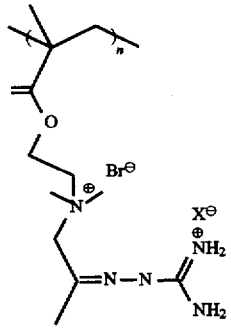

F-72 Class I mordant wherein $X^-$, is $CF_3SO^-$. When another anion is used, the designation will be followed by the anion.

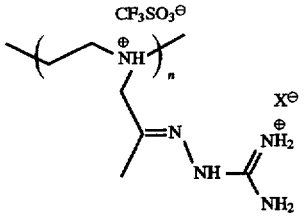

The following are comparative mordants.

MI-$CF_3SO_3$

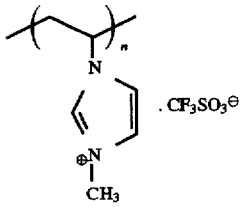

HEI-$Cl^-$

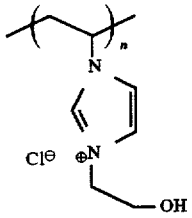

MI-PTSA

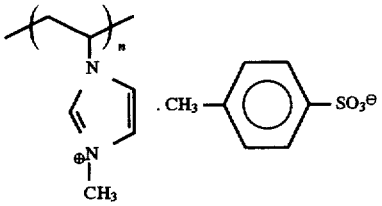

MP-$CF_3SO_3^-$

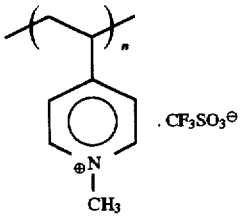

P132

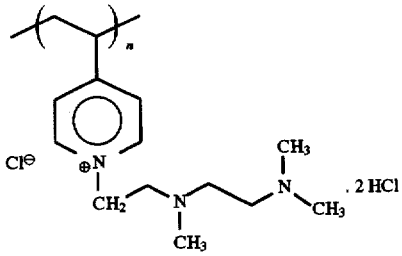

-continued

I222

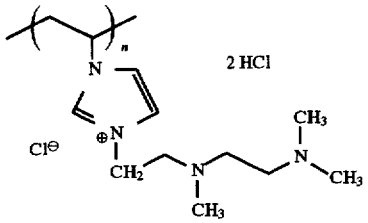

TEST METHODS

Bleeding Test

Test samples were coated at a 150 μm wet thickness on a 100 μm thick polyvinylidiene (PVDC) primed poly(ethylene terephthalate) (PET) film and dried at 130° C. for 2 minutes. The samples were imaged on an Hewlett Packard Paintjet™ XL300 at 25° C. and 50% relative humidity (RH), using a test pattern having a portion which is a single dot row of blue (cyan and magenta) passing through a solid background of red (yellow and magenta). After exactly 10 minutes, the samples were placed in Flip-Frame™ transparency protectors, available from Minnesota Mining and Manufacturing. The line widths (L.W.) of the samples were measured under magnification and recorded. The samples were then stored at 35° C. and 80% RH for 90 hours. At the end of 90 hours, the line widths were measured and recorded. A control film was also made, printed and tested in the same manner. The percentage of bleeding was calculated according to the following:

$$\frac{L.W.90\ \text{sample} - L.W.\ \text{Initial sample}}{L.W.90\ \text{control} - L.W.\ \text{Initial control}} \times 100$$

EXAMPLES

Synthesis of the Mordants

The following illustrates the synthesis of ink-jet mordants useful in the improved ink-receptive sheets of the invention.

Class A Mordant Synthesis

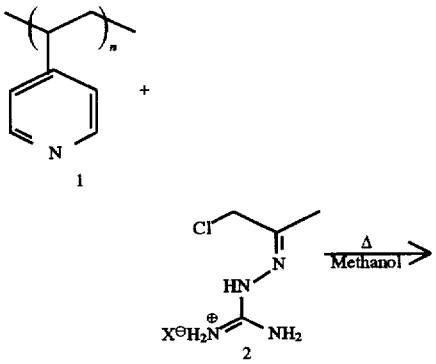

-continued

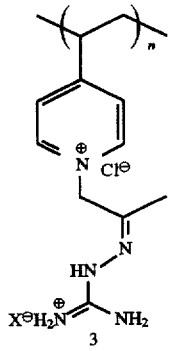

| X: | a = $CH_3SO_3$ | f = p-MePhSO$_3$ |
|---|---|---|
| | b = Br | g = $ClO_4$ |
| | c = $NO_3$ | h = F |
| | d = Cl | i = $CF_3SO_3$ |
| | e = $CF_3COO$ | j = $BF_4$ |

These syntheses illustrate the preparation of poly (vinylpyridines) (also called Reaction Scheme 1).

(a) A solution of 25 g 4-vinylpyridine in 50 ml methanol contained in a two-neck flask was flushed with dry nitrogen. After adding 0.5 g AIBN, the system was refluxed for 24 hours when a viscous material resulted. The polymer was precipitated from ether/hexane and dried in vacuo. Molecular weight: $M_w$=140,609, $M_n$=50285, $p_d$=2.8

(b) The procedure in (a) was repeated for both 4-vinyl- and 2-vinylpyridines using THF instead of methanol. Poly (4-vinylpyridine) was precipitated from THF during the reaction whereas poly(2-vinylpyridine) was not. The latter was precipitated from ether/hexane as described above.

The following syntheses, (with reference to Reaction Scheme 1) describe the preparations of various hydrazones from chloroacetone and appropriate salts of aminoguanidine.

(a) To a mixture of 30 g water and 30 g methanesulfonic acid, 20 g aminoguanidine bicarbonate was slowly added in portions at room temperature to obtain a clear solution of the corresponding methanesulfonate salt. The solution was warmed to about 40° C. and 15 ml chloroacetone was added dropwise. The solution was heated to about 50° C. for 15 minutes, cooled to room temperature, and then left at ice-temperature for 4–6 hours. The crystalline hydrazone was filtered and washed first with ice-cold isopropyl alcohol and then with diethyl ether. The hydrazone salt of methanesulfonate was dried in vacuo at about 60° C.

(b)–(h) The methanesulfonic acid was replaced successively by an equivalent amount of HBr, $HNO_3$, HCl, $CF_3COOH$, pMePhSO$_3$H, $HClO_4$, and HF and the procedure was repeated as described in 2(a) to obtain the hydrazone salts from (b)–(h).

(i) The methanesulfonic acid, supra, was replaced by trifluoromethanesulfonic (triflic) acid and the procedure was repeated as described in Example 2(a). The hydrazone salt, on overnight cooling, could be precipitated/crystallized, but was redissolved during filtration. The salt, however, was extracted in methylene chloride and then dried over anhydrous magnesium sulfate. Removal of solvent gave the hydrazone salt of trifluoromethanesulfonate as a thick liquid/semi-solid.

(j)–(o) The procedure above was repeated by replacing the triflic acid by $HBF_4$, $C_4F_9SO_3H$, $FSO_3H$, $HPF_6$, $ClSO_3H$, and $HSbF_6$ to obtain the hydrazone salts from (j)–(o).

The following illustrates the preparation of various polymeric mordants of class A.

(a) To a solution of 10 g poly(4-vinylpyridine) in 80 ml methanol, a solution of 21 g chloroacetonehydrazone-aminoguanidinium methanesulfonate (2a) in 30 g methanol was added and the mixture was heated to 50°–55° C. for 4–6 hours. On cooling the mixture to room temperature, the polymeric mordant with two counterions (first $Cl^-$ counterion with the ring quaternary nitrogen; second $CH_3SO_3^-$ counterion with the side chain iminium quaternary nitrogen) was precipitated from acetone, filtered, and dried in vacuo. The material is Polymeric dye Mordant A($X=CH_3SO_3^-/Cl^-$).

(b)–(o) The procedure in (3a) was repeated using chloroacetonehydrazone-aminoguanidinium salts of counterions (b)–(o) to obtain the mordants from (b)–(o).

Class B Mordant Synthesis

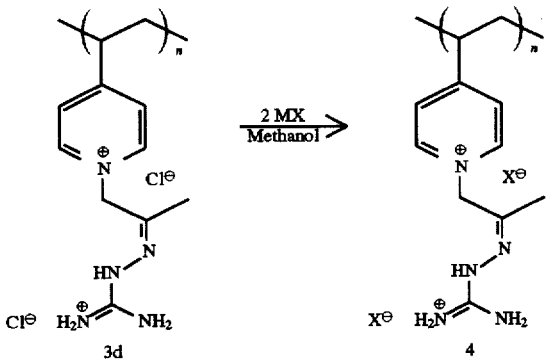

To a solution of 10 g polymeric mordant 3d in 30 ml methanol, two equivalents of sodium methanesulfonate was added with stirring. The solution was heated to 60° C. for 15 mins, filtered, and the mordant 4a was precipitated from ether and dried in vacuo. $X^-$ represents the same counteranions as described in Scheme 1.

Class C Synthesis

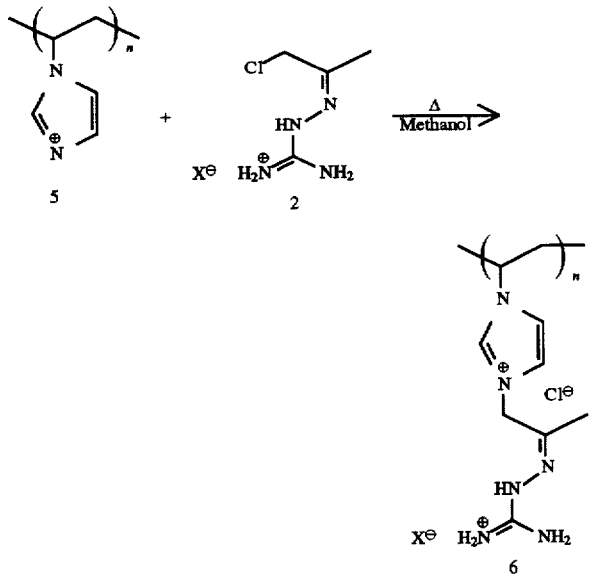

$X^-$ represents the same counterions as in Reaction Scheme 1.

To a solution of 10 g poly(N-vinylimidazole) 5 in 30 ml methanol, a solution of 28 g chloroacetonehydrazone-aminoguanidinium trifluoroacetate, 2e, wherein $X=CF_3COO$), in 30 ml methanol was added. The mixture was heated to 50° C. for 15 min. and cooled to room temperature. Mordant 6e was precipitated from acetone and dried in vacuo.

Class D Mordant Synthesis

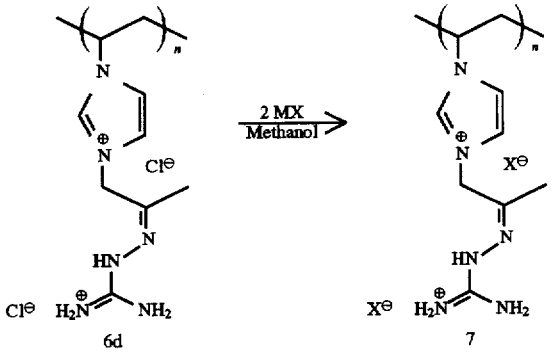

To a solution of 10 g 6d in 30 ml methanol, two equivalents of potassium triflate were added with stirring. The mixture was heated to 50° C. for fifteen minutes, cooled to room temperature, and then filtered. Mordant 7i ($X=CF_3SO_3$) was precipitated from ether and dried in vacuo. $X^-$ represents the same counterions as in Reaction Scheme 1.

Class E Mordant Synthesis

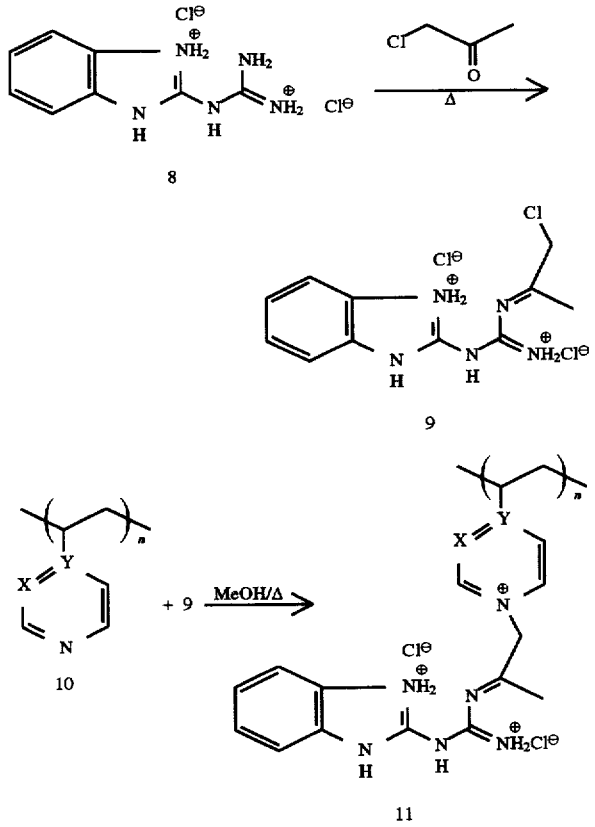

To a suspension of 10 g guanidinobenzimidazole in 30 g water, 13 g concentrated HCl was added dropwise, to obtain a diquaternary iminium hydrochloride salt. To this mixture was added dropwise 3.3 ml chloroacetone, and heated for 0.5 hour. The off-white flocculent precipitate was separated from the mixture and dried in vacuo to obtain the diquaternary iminium hydrochloride as a semicarbazone salt.

X represents the same counterions as in Reaction Scheme 1.

Class G Mordant Synthesis

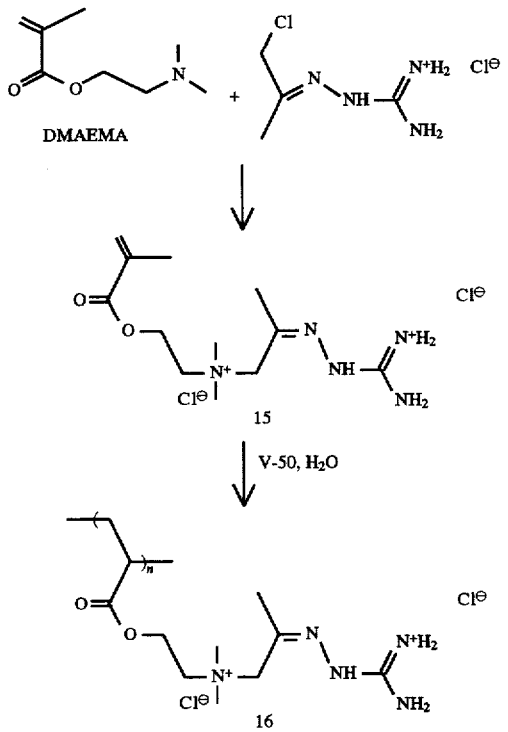

A reaction vessel fitted with a mechanical stirrer, a condenser, and a dropping funnel was charged with 100 parts of DMAEMA (N,N-dimethylaminoethyl methacrylate). A solution of 117.1 parts of chloroacetone hydrazone-aminoguanidinium hydrochloride in 285 parts of methanol was added to the vessel slowly from the dropping funnel in such a rate that the reaction exotherm does not exceed 50° C. After completion of the addition, the reaction solution was stirred for two hours. The solvent was then removed by rotary evaporation under vacuum at about 40° C. A white solid was formed; monomer 15 was characterized by its ⁻H NMR spectrum. 50 g of monomer 15 was then placed in a reaction vessel with 50 g of water, and 0.23 g of V-51 (2,2'-azobis(2-amiindinopropane)di-hydrochloride, available from Wako Chemical Co. The solution was purged for 20 minutes, then heated at 50° C. for 2 hours. A viscous polymer solution was obtained. $^1$H NMR and % solid analyses revealed polymerization to Mordant 16.

Class H Mordant Synthesis

These were made in a similar manner as Class G mordants, except with bromoacetone hydrazone-aminoguanidinium hypochloride in place of chloroacetone hydrazone-aminoguanidinium hydrochloride.

Class I Mordant Synthesis

These were made in a similar manner as Class M mordants, except polyethyleneimine (PEI) was used in place of PDMAEMA.

Synthesis of Ink-Receptive Copolymer A

The copolymer was prepared by combining 60 parts N-vinyl-2-pyrrolidone, 20 parts hydroxyethylmethacrylate, 10 parts of the ammonium salt of acrylic acid, 10 parts methoxyethylacrylate, 0.14 part Vazo™ 64, available from E. I. duPont de Nemours and Company, and 500 parts deionized water in a one-liter brown bottle. After the mixture was purged with dry nitrogen gas for five minutes, polymerization was effected by immersing the bottle in a constant temperature bath maintained at a temperature of 60° C. for 24 hours. The resulting polymerized mixture was then diluted with deionized water to give a 10% solution (hereinafter Copolymer A solution).

Synthesis of Ink-Receptive Copolymer B

This copolymer was prepared by combining 40 parts N-vinyl-2-pyrrolidone, 20 parts hydroxyethylmethacrylate, 10 parts of the ammonium salt of acrylic acid, 30 parts methoxyethylacrylate, 0.14 part Vazo™ 64, available from E. I. duPont de Nemours and Company, and 500 parts deionized water in a one-liter brown bottle. After the mixture was purged with dry nitrogen gas for five minutes, polymerization was effected by immersing the bottle in a constant temperature bath maintained at a temperature of 60° C. for 24 hours. The resulting polymerized mixture was then diluted with deionized water to give a 10% solution (hereinafter Copolymer B solution).

Alternate Synthesis of Ink-Receptive Copolymer B

A reaction vessel was fitted with a mechanical stirrer, a condenser and nitrogen system. 58.40 parts of deionized water and 2.30 parts of acrylic acid were added to the vessel, followed by 2.30 parts of 28.5% ammonium hydroxide solution in water. A pH of between 9 and 10 was obtained. 9.18 parts of N-vinyl-2-pyrrolidone (NVP) was added, along with 6.88 parts of methoxyethyl acrylate (MEA), 4.59 parts hydroxyethyl methacrylate (HEMA) and 32.13 parts of ethyl alcohol. The solution was purged with nitrogen for 20 minutes. After heating to 50° C., a solution of 0.092 parts of initiator Vazo™ 50 was added in 0.31 parts of deionized water. The solution was allowed to react at 50° C. for 18–28 hours. The extent of the reaction was monitored by percent solids and G.C. analysis. The reaction was halted when the unreacted monomer level fell below 0.02%. A viscous polymer solution resulted which was then diluted with deionized water to give a 10% polymer solution (hereinafter Copolymer B solution).

Synthesis of Ink-Receptive Copolymer C

The copolymer was prepared by combining 70 parts N-vinyl-2-pyrrolidone, 15 parts hydroxyethylmethacrylate, 5 parts of DMAEMA, 10 parts methoxyethylacrylate, 0.14 part Vazo™ 64, available from E. I. duPont de Nemours and Company, and 500 parts deionized water in a one-liter brown bottle. After the mixture was purged with dry nitrogen gas for five minutes, polymerization was effected by immersing the bottle in a constant temperature bath maintained at a temperature of 60° C. for 24 hours. The resulting polymerized mixture was then diluted with deionized water to give a 10% solution (hereinafter Copolymer C solution).

Preparation of Polymeric Beads

A. Preparation of Diethanolamine-adipic acid condensate promoter. Equimolar amounts of adipic acid and diethanolamine were heated and stirred in a closed reaction flask. Dry nitrogen was constantly bubbled through the reaction mixture to remove water vapor, which was condensed and collected in a Barett trap. When 1–1.5 moles of eater based on one mole of adipic acid and one mole of diethanolamine had been collected, the reaction was stopped by cooling the mixture. The resulting condensate was diluted with water.

B. Preparation of 30 micron polymethylmethacrylate beads. An aqueous solution of 52.9 kg deionized water, 685.2 g Ludox™ colloidal silica (10% solution), available from DuPont, 40.8 g of 10% solution of diethanolamine-adipic acid condensate promoter (made in step A), and 11.2 g potassium dichromate was stirred and adjusted to pH 4 by addition of 10% sulphuric acid. A solution of 53 g of polyvinylpyrrolidone K-30, 36.7 kg of monomer methylmethacrylate, 674.2 g of trimethylolpropane trimethacrylate and 112.4 g of Vazo™ 64, available from DuPont, were added to the above aqueous mixture and then stirred at 100–120 rpm for 10 minutes. The mixture was then passed through a Manton-Gaulin homogenizer four time at an internal pressure of 4800–6200 kPA, then poured into a reaction kettle which was purged with nitrogen, sealed and stirred at 60° C. overnight. The contents were then collected and centrifuged, followed by washing several times with water to yield a wet cake. The wet cake was then dried at ambient temperature to give a free flowing powder.

Examples 1 and 1C

An ink-receptive film of the invention was prepared in the following manner:

A coating solution was prepared by mixing 6 g of a copolymer B solution with a solution containing 3.5 g of a 10% aqueous solution of Vinol™ 523, available from Air Products and Chemicals, 0.5 g of a 10% aqueous solution of Gohsenol™ $KPO_3$, available from Nippon Gohsei, 0.1 g of a 1.7 molar solution of ammonium hydroxide, $1.72\times10^{-4}$ mole of "P134-Cl", 0.15 g of a 10% solution of 30 μm polymethylmethyacrylate (PMMA) beads, and 0.06 g of a 10% solution of "XAMA-7", pentaerythritol-tris-β-(N-aziridinyl) propionate, available from Hoechst Celanese, and was coated onto a backing of polyvinylidene chloride (PVDC) primed poly(ethylene terephthalate) (PET) film having a caliper of 100 μm. Coating was carried out by means of a knife coater at a wet thickness of 150 μm. The coating was then dried at about 145° C. for 2.5 minutes. This ink-receptive sheet was then tested for bleeding and the result is shown in Table 1.

Example 1C was made in the same manner as Example 1 except "P134-Cl" was omitted from the coating solution. This ink-receptive sheet was tested for bleeding and the result is also reported in Table 1.

Examples 2–15

These ink-receptive sheets were made and tested in the same manner as Example 1, except that $1.72\times10^{-4}$ mole of different mordants were used. The identity of the mordant is shown in Table 1, along with the test results. These mordants all contain the guanidine functionality.

Examples 16C–21C

These comparative ink-receptive sheets were prepared exactly as described in Example 1. Mordants which do not contain guanidine functionalities were used instead of the novel mordants used in image-receptive sheets of the invention. The mordants used and the results are shown in Table 1.

TABLE 1

| Examples | Mordant | % Bleed at 90 Hours |
|---|---|---|
| 1 | P134-$Cl^-$ | 29 |
| 1C | NONE | 100 |
| 2 | P134-$CH_3SO_3^-$ | 53 |
| 3 | P134-$NO_3^-$ | 41 |
| 4 | P134-$CF_3COO^-$ | 12 |
| 5 | P134-$BF_4^-$ | 53 |
| 6 | P134-$2CF_3SO_3^-$ | 59 |
| 7 | I224-$CF_3SO_3^-$ | 29 |
| 8 | I224-$Cl^-$ | 29 |
| 9 | I224-$BF_4^-$ | 47 |
| 10 | I224-$2CF_3SO_3^-$ | 53 |
| 11 | P134-Gi | 59 |
| 12 | I224-Gi | 53 |
| 13 | PI24 | 53 |
| 14 | MA1-CMA1-$Cl^-$ | 29 |
| 15 | P134-$CF_3SO_3$— | 23 |
| 16C | P132 | 82 |
| 17C | I222 | 76 |
| 18C | MP-$CF_3SO_3^-$ | 129 |
| 19C | MI-$PTSA^-$ | 135 |
| 20C | MI-$CF_3SO_3^-$ | 117 |
| 21C | HEI-$CL^-$ | 141 |

Examples 22 and 22C

The ink-receptive sheet of the invention was made by mixing 5 g of Copolymer A solution with a solution containing 10 g of a 10% aqueous solution of Vinol™ 523, 0.06 g of a 1.7 molar solution of ammonium hydroxide, 0.45 g of a 10% P144 solution, and 0.15 g of a 10% aqueous solution of XAMA. This resultant solution was coated as described in Example 1. The comparative sheet was made in the same manner except that no P144 was added. After imaging on an Hewlett-Packard "Paintjet XL300", the samples were placed in a 35° C., 80% RH chamber with the images exposed to the atmosphere. After 48 hours, Example 22 showed excellent retention of image quality and resolution, whereas Example 22C showed dramatic blurring and loss of resolution.

Examples 23 and 23C

These ink-receptive sheets were made in the same manner as Examples 22 and 22C, except that Natrosol™ 250L, available from Aqualon, was substituted for Vinol™ 523.

Again, the examples containing P144 showed excellent retention of image quality and resolution whereas 23C showed dramatic blurring and loss of resolution after identical imaging, heating, and humidity aging.

Examples 24–35

These ink-receptive sheets were prepared in the following manner.

A coating solution was made by mixing 6 g of copolymer B solution with a solution containing 3.5 g of a 10% aqueous solution of Vinol™ 523, 0.5 g of a 10% aqueous solution of Gohsenol™ $KPO_3$, 0.1 g of a 1 molar solution of hydrochloric acid, $1.73\times10^{-4}$ moles of various mordants with guanidine functionality, as shown in Table 2, and 0.15 g of a 10% aqueous solution of 30 μm PMMA beads. This composition did not contain a crosslinker. The results are shown in Table 2.

Example 36C and 37C

These ink-receptive sheets were made in the same manner as Example 24, except with mordants having no guanidine groups. The mordants and the results are shown in Table 2.

TABLE 2

| Example | Mordant | % Bleed |
|---|---|---|
| 24 | P134$CF_3SO_3$ | 30 |
| 25 | P134-Cl | 10 |
| 26 | P134-$CH_3SO_3$ | 65 |
| 27 | P134-$NO_3$ | 45 |
| 28 | P134-$CF_3CO_2$ | 15 |
| 29 | P134-$BF_4$ | 50 |
| 30 | I224-CF3$SO_2$ | 25 |
| 31 | I224-Cl | 30 |
| 32 | I224-$BF_4$ | 60 |
| 33 | P134-GI | 60 |
| 34 | I224-GI | 50 |
| 35 | P124 | 45 |
| 36C | P132 | 105 |
| 37C | I222 | 95 |

Examples 38–40

These ink-receptive sheets were prepared in the following manner.

A coating solution was made by mixing 12 g of copolymer C solution with a solution containing 6.4 g of a aqueous solution of Vinol™ 523, 1.6 g of a 10% aqueous solution of Gohsenol™ $KPO_3$, 1.0 g of mordants as shown in Table 3, and 0.3 g of a 10% aqueous solution of 30 μm PMMA beads. This composition did not contain a crosslinker. The results are shown in Table 3.

TABLE 3

| Example No. | Mordant | Percent Bleed |
|---|---|---|
| 38 | F-72 | 30 |
| 39 | F-71($Cl^-$) | 19 |
| 40 | F-71($TfA^-$) | 8 |

Examples 41 and 42C

These two-layer ink-receptive sheets were prepared in the following manner.

The ink-sorbent underlayer was made from 10.8 g of a 10% aqueous solution of Airvol™ 540, 7.2 g of a 10% aqueous solution PVP-K90, and 2.0 g of a 10% aqueous solution of mordant P134-C1 were coated onto a PVDC primed polyester film. The primer coat was 80 μm in thickness; the ink-sorbent layer was 160 μm in thickness. Onto this was then coated a 120 μm thick liquid-permeable surface layer comprising 13 g of 1% Methocel™ K-15M in a solvent having a 1:1 ratio of ethanol and water, 0.5 g of a 10% aqueous solution of 30 μm PMMA beads. Each coat was individually dried at 110° C. (230° F.) for 2.5 minutes. Example 42C was made in an identical fashion, except that the mordant was omitted. The films were then imaged on a Hewlett-Packard DeskJet™ 1200C printer and tested as described above. After 21 days Example 41 showed 2mm bleed; Example 42C showed 13 mm bleed.

Example 43

This two-layer ink receptive sheet was made in the following manner.

The ink-sorbent underlayer was made from 18.5 g of a 10% aqueous solution of Airvol™ 540, and 1.5 g of a 10% aqueous solution of mordant P134-$C_1$ and was coated onto a PVDC primed polyester film, the primer coat being 80 μm in thickness. The thickness of the wet under layer was 160 μm Onto this was then coated a 120 μm thick liquid-permeable surface layer comprising 15 g of 1% Methocel™ K-15M in a solvent having a 1:1 ratio of ethanol and water, 0.1 g of a 10% aqueous solution of Syloid™ 620 beads, and 0.5 g of FC 430. Each coat was individually dried at 110° C. (230° F.) for 2.5 minutes. After 10 days at 35° C. and 80% RH, the film showed 1% bleed.

Example 44

This two-layer ink receptive sheet was made in the following manner.

The liquid-sorbent under layer was prepared by first making a solution containing 320.4 g of an 18% aqueous solution of PVP, 100 g of a 20% aqueous solution of copolymer B, 40 g of a 50% solution in ethanol of Carbowax™ 600, 13 g of mordant P134, 178 g of DI water, 178 g of ethanol, and 0.5 g ammonium hydroxide (30% concentration). The final coating solution was then prepared by mixing 90 g of this solution with 0.32 g of Xama7 polyaziridine crosslinker. This was then coated onto the backing to a thickness of 160 μm, and dried at 121° C. (250° F.) for 3 minutes.

Onto this was then coated a 60μm thick liquid-permeable surface layer comprising a mixture of 60 g of a 61% solids aqueous solution of Polyox® WSR-205, available from Union Carbide, with 15 g of a 25% solids solution of Dispal®23N4-20 aluminum sol, available from Vista Chemical and 25 grms of deionized water. This mixture was then coated atop the liquid-sorbent layer at a thickness of 60μm. The surface layer was then dried at 121° C. (250° F.) for 3 minutes.

The sample was then imaged on a Hewlett-Packard Deskjet® 122C ink-jet printer. After 90 hours at 40° C. and 80% RH, the film showed 25% bleed (a comparative film shows 100% bleed).

Example 45

This two-layer ink receptive sheet containing mordant in each layer was made in the following manner.

The liquid-sorbent underlayer was made similar to Example 44. Onto this was then coated a 80 μm thick liquid-permeable surface layer comprising 25 g of a 4% aqueous solution of Polyox® WSR-205 and 4 g of Dispal® 23N4-20 and 1 g of a 10% aqueous solution of P134 mordant.

The top coat was dried at 121° C. (250° F) for 3 minutes. The film was then imaged on the HP DeskJet® 1200C. After 90 hours at 40° C. and 80% RH, the film showed 25% bleed.

Examples 46 and 47C

Synthesis of Copolymer D

The copolymer was prepared by combining 83 parts N-vinyl-2-pyrrolidone, 15 parts Carbowax® 500 acrylate (NK ester AM-90G, available from Shin-Nakamure Chemical Co. Ltd.) 23 parts DMAEMA, 0.4 part Vazo® 52 m available from DuPont, 150 parts deionized water and 150 parts ethyl alcohol in a one liter brown bottle. After the mixture was purged with dry nitrogen gas for 5 minutes, polymerization was effected by immersing the bottle in a constant temperature bath maintained at 50° C. for a period of 18 hours. The resulting polymerized resin was diluted with deionized water to give a 10% solution.

The coating solution was then prepared by mixing two solutions. First, 60 g of 10% solution of copolymer D was mixed for 20 minutes with 12 g of 10% Carbowax 600 solution. Second, 50 g of 8% Airvol 540 solution in water was mixed with 3.37 g of 15% Nalco 2326 colloidal silica from Nalco Chemical Co. 10 grams of the copolymer mixture was then mixed with 12.5 g of the Airvol/Nalco mixture, and 1.2 g of 10% solution of mordant P134-$CF_3SO_2$ was added, along with 0.25 g of 10% 30 μm PMMA beads and 4 drops of 10% Triton® X-100. The resulting solution was coated as described in Example 1.

The comparative sheet was made in the same manner except that no mordant was added. After imaging the two sheets on a Hewlett-Packard Deskjet® 1200C ink-jet printer, the samples were placed in PolyVu® transparency protectors and stored in a 25° C., 80% RH chamber for 216 hours. The sheet of the invention showed 3.70% bleed where the comparative sheet showed 100% bleed.

Example 48

This example shows a nontransparent vinyl substrate used with an ink-receptive layer of the invention which is useful for commercial graphics applications.

A white vinyl film is coated on one major surface with an adhesive, and a release liner is placed thereover.

The sorbent underlayer was prepared as described in Example 44, and is coated at 160 μm onto the white vinyl film, on the opposing major surface. The liquid-sorbent layer is then dried at 121° C. for 3 minutes.

The liquid-permeable surface layer was also prepared as stated in Example 44, and coated atop the liquid-sorbent under layer to a thickness of 60 μm at dried for 3 minutes at 121° C.

The resulting two layer coated vinyl film was then printed with good image quality on the Hewlett-Packard Designjet® 650C, and a second identical sample was also imaged with good image quality on the Encad Novajet® II.

What is claimed is:

1. An ink-receptive sheet comprising a substrate bearing on at least one major surface thereof, an ink-receptive layer comprising an ink receptive polymer and an effective amount of at least one polymeric mordant comprising a guanidine functionality having the formula

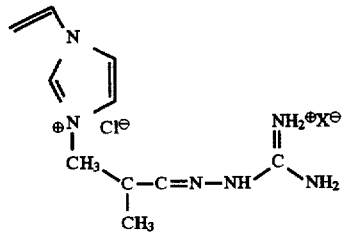

wherein X—is selected from the group consisting of $Cl^-$, $CF_3COO^-$, phenyl-$CH_3SO_3^-$, $BF_4^-$, $CH_3SO_3^-$, $NO_2^-$, $Br^-$ and $CF_3SO_3^-$.

2. An ink-receptive sheet comprising a substrate bearing on at least one major surface a two layer composite medium for sorbing liquids comprising:

a) a liquid-sorbent underlayer comprising an imaging copolymer, and overlying said underlayer, b) a liquid-permeable surface layer, the liquid sorbtivity of said underlayer being greater then the liquid sorptivity of said surface layer whereby the composite medium has a sorption time less than the sorption time of a thickness of said surface layer equal to the thickness of the composite medium, wherein at least one layer comprises from about 1 to about 15 parts a mordant having the following general formula:

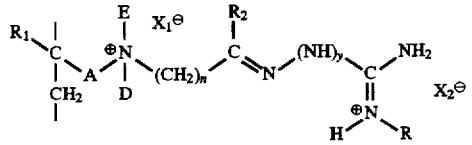

wherein

A is selected from the group consisting of a COO-alkylene group having from 1 to about 5 carbon atoms, a CONH-alkylene group having from 1 to about 5 carbon atoms, —COO—$(CH_2CH_2O)$n—$CH_2$—, —CONH—$(CH_2CH_2O)$n—$CH_2$— and —$(CH_2CH_2NH_2Cl)$n, wherein n is from 1 to about 5;

E and D are independently selected from the group consisting of alkyl group having from 1 to about 5 carbon atoms;

or A, E, D and N are combined to form a heterocyclic compound selected from the group consisting of

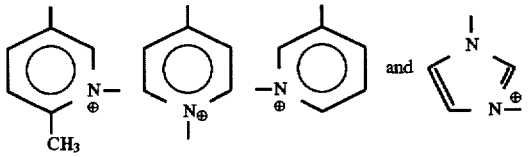

wherein $R_1$ and $R_2$ are independently selected from the group consisting of hydrogen, phenyl, and an alkyl group containing from 1 to about 5 carbon atoms;

R is selected from the group consisting of hydrogen, phenyl, benzimidazolyl, and an alkyl group containing from 1 to about 5 carbon atoms, y is selected from the group consisting of 0 and 1, and $X_1$ and $X_2$ are anions.

3. An ink-receptive sheet according to claim 2 wherein said mordant is contained in said liquid-sorbent layer.

4. An ink-receptive sheet according to claim 2 wherein said mordant is contained in said liquid-permeable layer.

5. An ink-receptive sheet according to claim 2 wherein each layer of said composite medium contains a mordant.

6. An ink receptive sheet according to claim 2, further comprising a sol selected from the group consisting of alumina sols and silica sols.

7. An ink receptive sheet according to claim 2 wherein at least one layer further comprises a sol selected from the group consisting of alumina sols and silica sols.

8. An ink-receptive sheet according to claim 2 wherein said ink-receptive layer further comprises a particulate.

9. An ink-receptive sheet according to claim 8 comprising a first particulate and a second particulate wherein said first particulate is a polymeric particulate having a average size of from about 5 μm to about 40 μm, and said second particulate has an average size of from about 0.25 μm to about 1 μm.

10. An ink-receptive sheet according to claim 2 wherein said substrate is selected from the group consisting of cellulose esters, polyamides, vinyl chloride polymers and copolymers, polyolefin and polyallomer polymers and copolymers, polysulphones, and polycarbonates.

11. An ink-receptive sheet according to claim 10 wherein said substrate is transparent.

12. An ink-receptive sheet according to claim 10 wherein said substrate comprises a first major surface and a second major surface, wherein said first major surface bears thereon said composite medium for sorbing liquids and said second major surface bears thereon an adhesive layer.

* * * * *